US006102033A

United States Patent [19]

Baribeau et al.

[11] Patent Number: 6,102,033

[45] Date of Patent: Aug. 15, 2000

[54] ATTACHMENT SYSTEM FOR REPLACEMENT HELMET RESPIRATOR LENS

[75] Inventors: Gary A. Baribeau, Hudson, Wis.; James A. Burns, Lake Elmo, Minn.; William A. Mittelstadt, Woodbury, Minn.; William J. Swanson, St. Paul, Minn.

[73] Assignee: 3M Innovative Properties Company, St. Paul, Minn.

[21] Appl. No.: 09/037,628

[22] Filed: Mar. 10, 1998

[51] Int. Cl.[7] ..... A62B 17/04

[52] U.S. Cl. ..... 128/201.24; 128/201.15; 2/9; 2/427; 2/429

[58] Field of Search ..... 2/8, 9, 427, 429; 128/206.23, 201.15, 201.12, 200.28, 200.27, 201.24

[56] References Cited

U.S. PATENT DOCUMENTS

| | | | |
|---|---|---|---|
| 2,610,323 | 9/1952 | Johnson | 2/8 |
| 2,631,285 | 3/1953 | Maillart | 2/8 |
| 2,910,062 | 10/1959 | Potash | 128/141 |
| 2,952,853 | 9/1960 | Benzel | 2/14 |
| 2,996,722 | 8/1961 | Jacobs | 2/14 |
| 3,259,127 | 7/1966 | Klinger et al. | 128/141 |
| 3,315,673 | 4/1967 | Morton, Jr. | 128/141 |
| 3,323,135 | 6/1967 | Miller | 2/14 |
| 3,411,158 | 11/1968 | Benner | 2/8 |
| 3,774,239 | 11/1973 | Kotzar | 2/10 |
| 3,805,294 | 4/1974 | Rose et al. | 2/10 |
| 3,854,146 | 12/1974 | Dunning | 2/9 |
| 4,021,858 | 5/1977 | Neeld et al. | 2/9 |
| 4,097,929 | 7/1978 | Lowe et al. | 2/10 |
| 4,183,101 | 1/1980 | Melander | 2/424 |
| 4,280,491 | 7/1981 | Berg et al. | 128/201.24 |
| 4,462,119 | 7/1984 | Rudd | 2/424 |
| 4,577,348 | 3/1986 | Hoffmann | 2/84 |
| 4,606,670 | 8/1986 | Angell | 403/291 |
| 4,752,974 | 6/1988 | Haino | 128/200.28 |
| 4,989,598 | 2/1991 | Berg et al. | 128/206.23 |
| 5,279,286 | 1/1994 | Chen | 128/201.29 |
| 5,689,833 | 11/1997 | Allen et al. | 128/201.15 |

FOREIGN PATENT DOCUMENTS

| | | |
|---|---|---|
| 748 423 | 9/1970 | Belgium . |
| 26 59 187 | 7/1977 | Germany . |
| 81 10 871 | 3/1982 | Germany . |
| 91 09 795 | 4/1992 | Germany . |
| WO 86/04790 | 8/1986 | WIPO . |

OTHER PUBLICATIONS

Product information: *3M Positive Pressure Respirators*, 3M Occupational Health and Environmental Safety Division, Dec., 1996.

Standard: "American National Standard Practice for Occupational and Educational Eye and Face Protection", American National Standards Institute, Inc., (Approved Feb. 2, 1989).

Brochure: "Powered Respirators", Racal Health & Safety, (undated).

*Primary Examiner*—John G. Weiss
*Attorney, Agent, or Firm*—James A. Rogers

[57] ABSTRACT

A replaceable lens attachment system for respiratory devices and methods of use. The replaceable lens attachment system includes a face shield having rotatable attachment members and a replaceable lens. The rotatable attachment members include cams and flanges. The attachment system may further comprise a helmet respirator with support elements disposed thereon. The method includes bowing the lens and inserting it into the frame. The rotatable attachment members are rotated to urge the lens into the frame and cover the frame. The flanges and support elements provide impact resistance to the lens.

23 Claims, 3 Drawing Sheets

ATTACHMENT SYSTEM FOR REPLACEMENT HELMET RESPIRATOR LENS

FIELD OF THE INVENTION

This invention relates to replaceable lens assemblies for helmet respirators.

BACKGROUND

Respirators are frequently worn by people working in areas where the air may be contaminated with toxic or noxious substances such as particulates, gases and vapors. For example, the air in a sanding or grinding area may contain airborne particulates, the air in a painting area may contain droplets of paint or solvent vapors, and the air in a welding area may contain harmful particles or fumes. The respirator may filter the air or it may provide a supply of uncontaminated air.

A respirator may include a helmet or similar device for impact protection. Respirators that include helmets are frequently worn by people working in areas where there is a potential for impact from a foreign object. Typically, this type of respirator comprises a helmet with an air inlet, face shield, and an independent air supply.

The face shield has a lens that may be a permanent part of the face shield or it may be removable and replaceable in a frame. In many instances, a replaceable lens may be more economical to replace than having to replace the entire face shield. However, because the lens is used in a respirator function, the attachment system should provide an adequate seal. In addition, the lens as installed should provide for some level of impact protection.

Various government agencies and industry organizations define certain requirements and standards for protective gear, including helmets and respirators. For example, the National Institute of Occupational Safety and Health (NIOSH) certifies certain safety equipment, such as respirators, for the workplace and the American National Standards Institute (ANSI) recommends voluntary consensus industry standards, such as high mass and high velocity impact, in the United States. Other agencies and organizations around the world establish standards for helmets and respirators. Attempts to meet these types of standards and requirements have resulted in fairly complex attachment systems for replaceable lenses for respirators.

For example, U.S. Pat. No. 4,097,929 describes a protective visor that has an arcuately curved frame that receives a flexed sheet of resilient transparent material. The sheet is attached to the outside of the frame using mutually offset lugs. The sheet is inserted through a fairly complex process of pressing on the rear surface of the visor panel in the region of one of the outer lugs and simultaneously pressing from the front at the vertical edge of the visor panel. The lugs are on the outside frame of the face shield.

SUMMARY

There is a need in the art for a replaceable lens attachment system for respirators. The lens should be easy to insert and remove, yet provide a relatively tight seal and some level of impact resistance. The system should be suitable for use with respirators that include helmets and similar devices.

The present invention includes a lens attachment system and method of use for exchanging replaceable face shield lenses in a respirator system. The respirator includes a helmet with an attached face shield and replaceable lens.

This system is capable of meeting ANSI Z87.1-1989 for high mass impact yet is also capable of meeting minimum NIOSH respiratory standards.

In one embodiment of the present invention, a lens replacement system including a face shield frame for a respirator and a lens is described. The face shield frame includes rotatable attachment members. The lens attachment system may further include a helmet. The helmet includes support elements. Preferably, the support elements protrude from the leading edge of viewing area of the helmet.

The lens is a flat, preferably transparent lens. In a preferred embodiment, the lens is made from polycarbonate. Other suitable materials may include cellulose acetate, triacetate, polyester, and acrylic. The lens may further include materials or coatings to aid in scratch resistance, chemical resistance, anti-fogging resistance and the like. The lens may include alignment guides. Preferably, the alignment guides are notches.

The face shield frame is attached to the helmet respirator and generally has an arcuate shape. The rotatable attachment members are disposed along the inside of the frame. The attachment members include a cam and a flange. The lens frame may further include alignment members that correspond to alignment guides on the lens. In a preferred embodiment, the alignment members are pins.

As assembled, the lens fits within the face shield frame. Alignment guides on the lens and alignment members on the face shield frame may hold the lens in proper orientation within the frame. The cams of the rotatable attachment member urge the lens against the frame of the face shield. The flanges and support elements cover the lens to provide impact resistance thereto. Protruding locks may be provided to lock the attachment members in place on the frame with respect to the lens. Stops may be provided to prevent over-rotation of the attachment members.

In another embodiment of the present invention, a method of inserting a replaceable lens into a face shield for a respirator having a helmet is described. The method includes providing a helmet respirator, face shield including rotatable attachment members and a replaceable lens. The helmet respirator includes support elements. The attachment members include a cam and flange.

The lens is bowed and inserted into the frame. The lens may be aligned using the alignment members. The attachment members are rotated such that the cams urge the lens against the frame while the flanges, together with the support elements of the helmet, provide a degree of impact resistance to the lens. Protruding locks may be provided on the frame. The attachment members engage the protrusions to lock the attachment members in place.

This method provides a simplified approach to lens replacement when compared to prior art processes of attaching a lens to a frame with a fairly complex system, such as retaining lugs. The system of the present invention does not require reverse bending to install the lens in the frame, which may be difficult and which may cause crazing of lens coatings.

The lens attachment system of the present invention permits the use of extremely wide view lenses in respirator applications. The replaceable lenses are easy to install within the frame, yet provide a level of impact resistance and respiratory protection.

Other advantages of the invention will be apparent from the following detailed description and the figures.

DETAILED DESCRIPTION OF THE PREFERRED EMBODIMENTS

In describing preferred embodiments of the invention, specific terminology is used for the sake of clarity. The invention, however, is not intended to be limited to the specific terms so selected, and it is to be understood that each term so selected includes all technical equivalents that operate similarly.

Figure 1A:
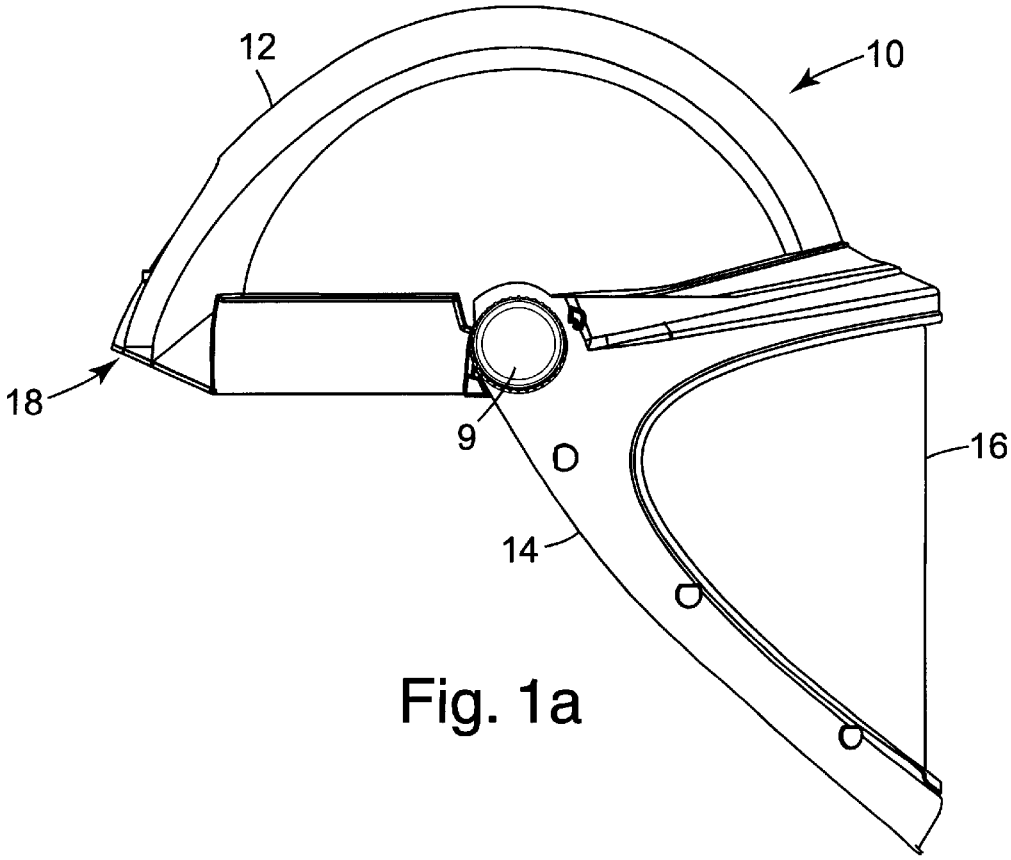
FIG. 1*a* is a side plan view of a helmet respiratory device with attached face shield.
Figure 1B:
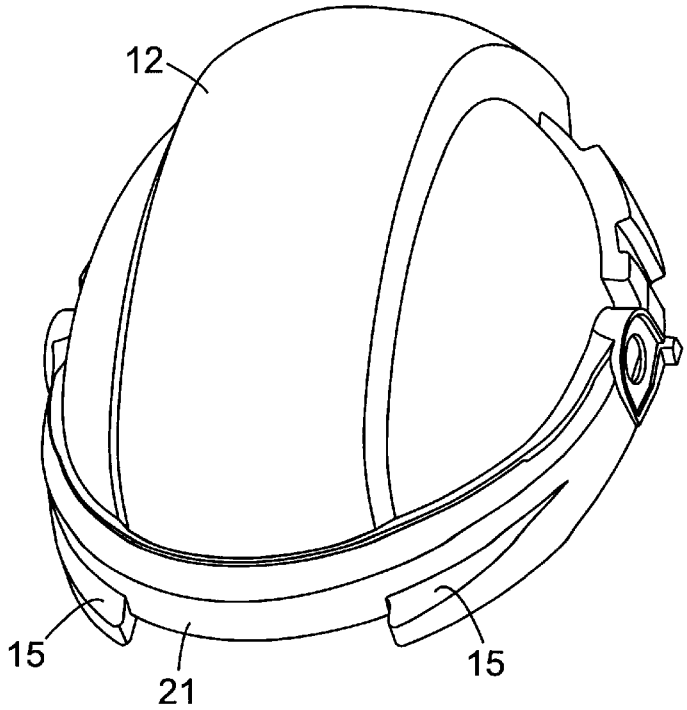
FIG. 1*b* is a perspective view of the helmet respiratory device of FIG. 1.

Referring to the drawings and specifically to FIG. 1*a*, the attachment system 10 is for use with a respirator having a helmet 12. The helmet respirator 12 has a moveable face shield frame 14 with a replaceable lens 16. Many types of respirator helmets, that meet varying types of regulations, may be used. Examples of suitable helmets include the Whitecap I™, Whitecap II™ and Airhat™ helmets available from 3M of St. Paul, Minn. Typically, the respirator 12 has an air supply inlet 18 for piping fresh air into the respirator 12. Helmet respirator 12 may further include a jaw piece, as described in commonly assigned U.S. patent application Ser. No. 09/037,633, filed Mar. 10, 1998, entitled Protective Helmet System, filed on the same date herewith. Helmet 12 may further include support elements 15, as discussed below and depicted in FIG. 1*b*.

Lens 16 is generally transparent. The material of the lens 16 is dictated to a large degree by the application of use for the respirator 12. For most applications, it is desirable to have a transparent lens. Further, the lens 16 may provide a degree of penetration resistance. Accordingly, the preferred material for the lens of the present invention is polycarbonate. Other potentially suitable materials may include cellulose acetate, triacetate, polyester, and acrylic. The lens may be tinted or treated to impart scratch resistance, chemical resistance, anti-fogging capabilities and the like.

In the present invention, lens 16 is capable of being bowed. A flat lens is preferred because of manufacturing cost and due to the characteristics of a flat lens that assist in sealing the lens to the face shield frame, as more fully explained below. For purposes of this invention, the term "flat lens" includes lenses that have a degree of curvature but are still capable of being bowed and will substantially return to their original orientation after being bowed.

Figure 2:
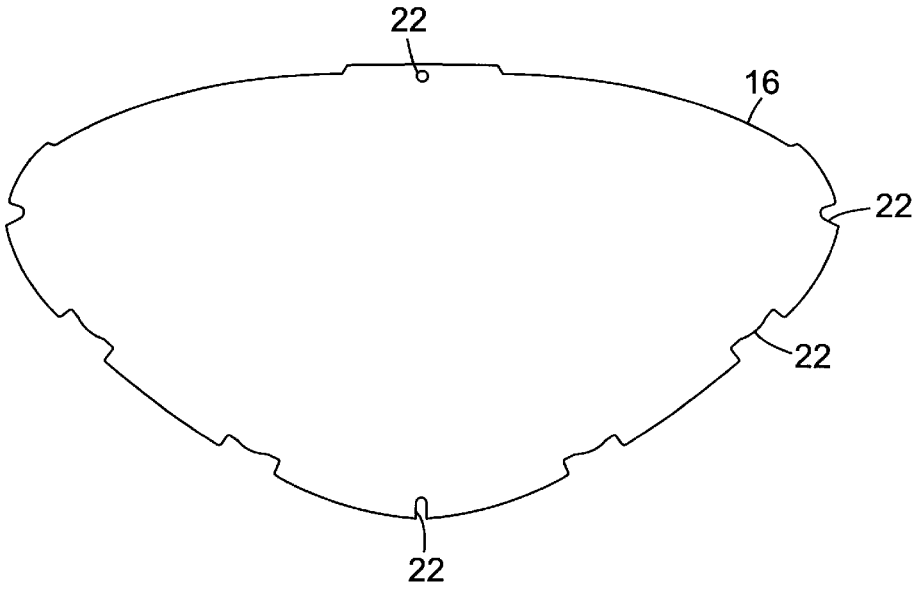
FIG. 2 is a plan view of a replaceable lens of the present invention.

Referring to FIG. 2, lens 16 may have alignment guides 22 disposed along its periphery. These alignment guides 22 correspond to alignment members 24 on the frame 14, as more fully discussed below. The shape and number of guides 22 may vary according to the number of corresponding alignment members 24. Preferably, the alignment guides 22 are notches because of cost considerations with respect to manufacturing lenses.

Figure 3:
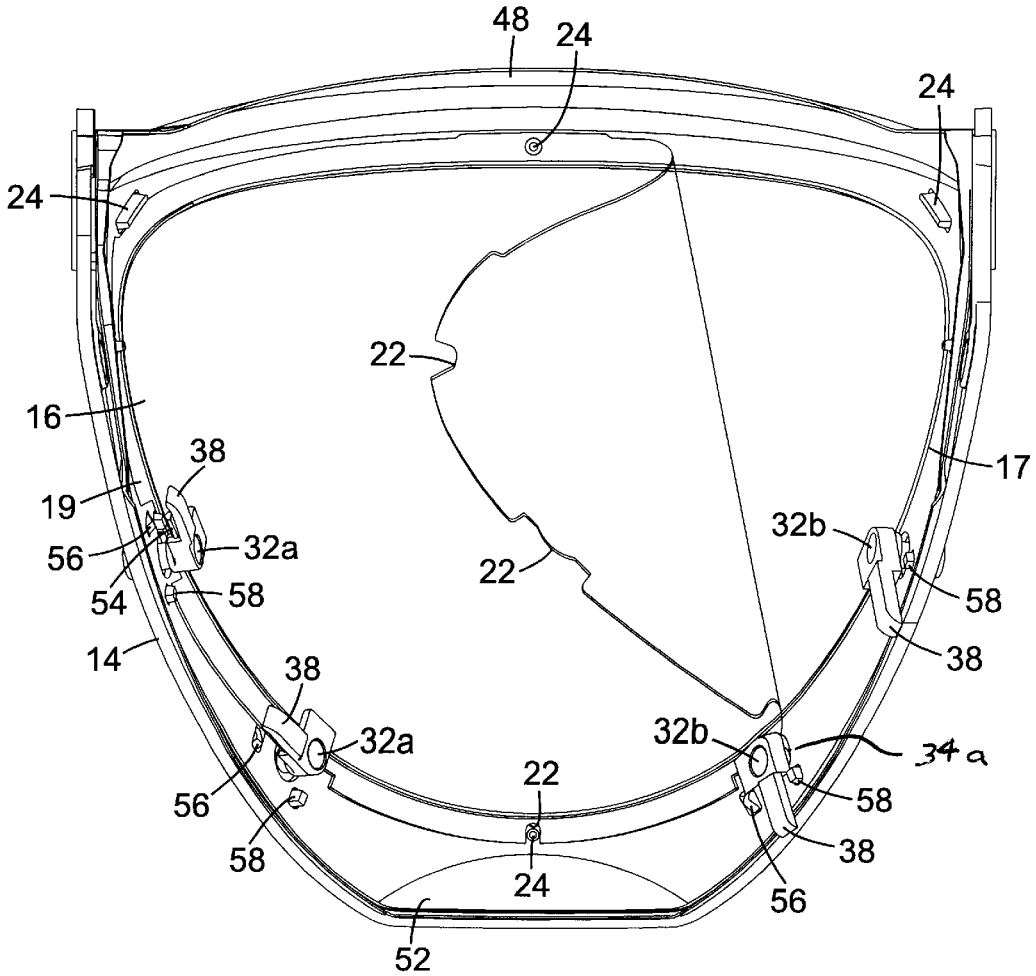
FIG. 3 is a rear plan view of the attachment system of the present invention.

Referring to FIG. 3, lens 16 fits within face shield frame 14. For purposes of this invention, lenses that are held on the inside of the frame 14 are considered to be oriented within the frame. The lens 16 is bowed prior to placing it within the frame 14. Bowing the flat lens 16 places a stress load on the lens 16 such that if left unsupported, the lens 16 will substantially revert to its original, flat orientation. Accordingly, when the lens 16 is placed within the frame, the stress load acts to seal the lens 16 against the side edges 17, 19 of the frame 14.

With reference to FIG. 1*a* and continuing reference to FIG. 3, face shield frame 14 is attached to respirator 12. The face shield frame 14 may be attached to the respirator 12 in any number of ways that are known in the art. Preferably, the face shield frame 14 is attached by a hinge assembly 9 that permits the face shield to be positioned either in a down position, thereby protecting the wearer's face, or in an up position, thereby permitting the wearer access to his or her face.

Figure 5:
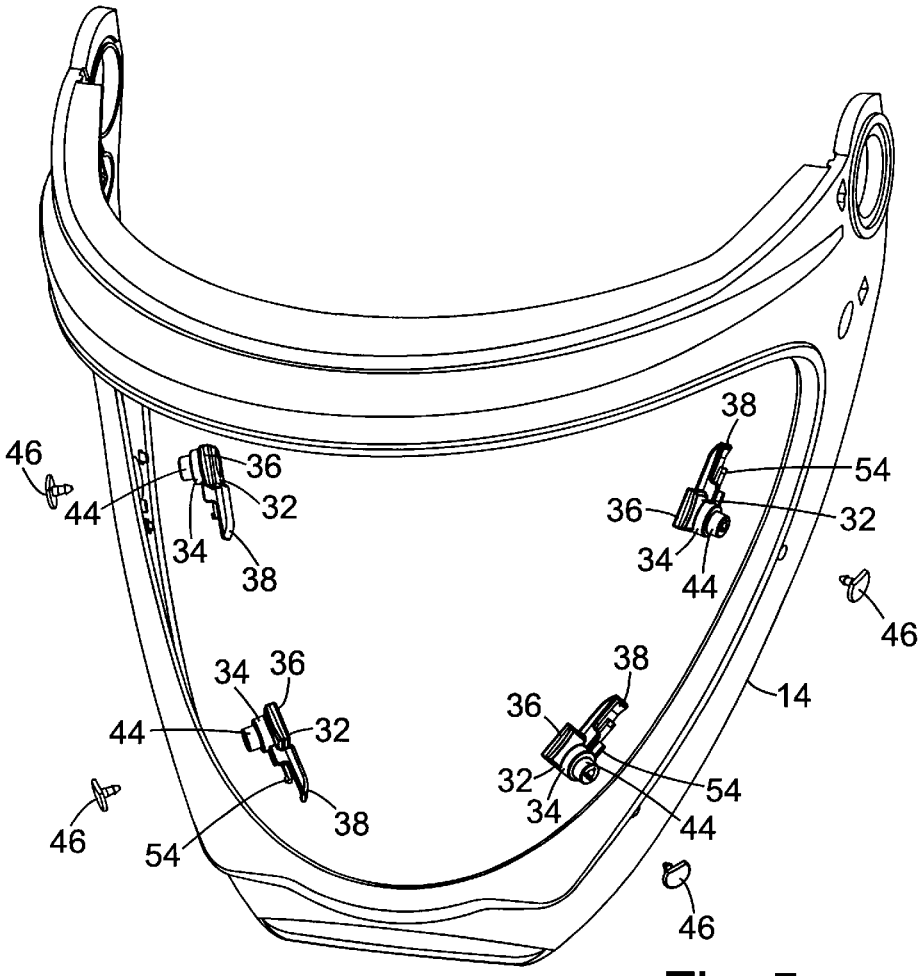
FIG. 5 is an exploded perspective view of an embodiment of the attachment system of the present invention.

With reference to FIG. 5, the frame 14 is designed to provide a wide-view lens with good peripheral and upward and downward vision. Face shield frame 14 is generally arcuate and may be constructed of any of a number of materials known in the art.

Figure 4:
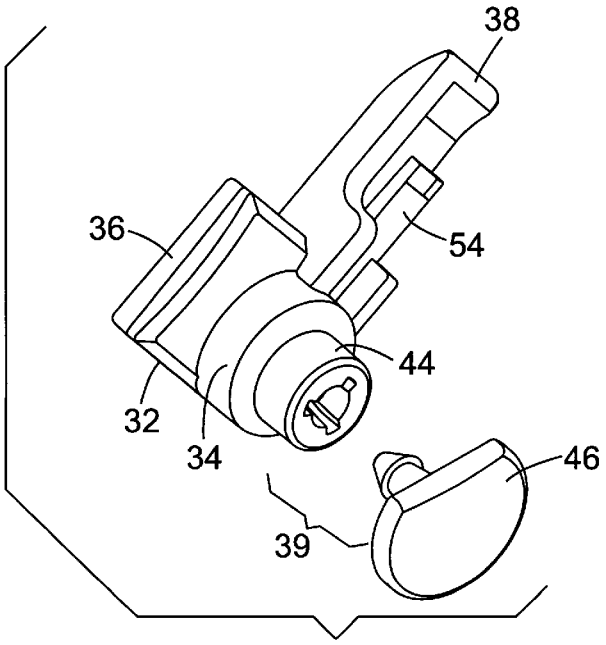
FIG. 4 is a perspective view of an attachment member of the present invention.

With reference to FIGS. 3, 4 and 5, the face shield frame 14 has attachment members 32 disposed along the inside periphery. Attachment members 32 preferably include a cam 34 and a flange 36. Attachment members 32 may further include a positioning lever 38 and a snap connector 39 including an axle 44 and cap 46.

Axle 44, positioning lever 38 and flange 36 are connected to cam 34. Axle 44 extends from cam 34, generally perpendicular to the positioning lever 3 8 and flange 36. In other embodiments, positioning lever 38 may be oriented in a different manner with respect to the axle 44, flange 36 and cam 34.

The axle 44 extends through a receptacle (not depicted) in the face shield frame 14. Cap 46 is snapped into or over the axle 44, thereby rotatably connecting attachment member 32 to frame 14. The attachment member 32 freely rotates about the axle 44. Those skilled in the art will recognize that the members may be rotatably connected to the frame using many different structures known in the art, all of which are considered to be within the scope of this invention.

Cam 34 is sized to engage the edge of lens 16 upon rotation of the attachment member 32, thereby urging the lens 16 into the frame 14. The engagement of the cam 34 places a load on the lens 16 that results in the lens 16 generally sealing against the top 48 and bottom 52 of the face shield frame 14.

Flange 36 extends from cam 34. The flange 36 may engage the lens 16 within the frame 14 or may cover a portion of the lens 16. The flange 36, in combination with the support elements 15 on the helmet 12, provides impact resistance to the lens 16. For purposes of this invention, impact resistance in this context means that the lens does not detach from the frame such that after an impact from an object, the lens remains substantially retained within the frame. For purposes of this invention, the term "cover" means to overlay a portion of the lens, typically an edge portion, to provide support against an impact. Preferably, the flange 36 covers the lens within 0 to 4 millimeters of the lens surface. Most preferably, the flange 36 covers the lens 16 by touching the lens surface. Accordingly, the flange 36 may take any number of shapes adequate to cover the lens 16 and therefore provide impact resistance. The size of the flange 36 may be subject to visibility considerations.

The attachment members 32 are made of materials that exhibit stiffness and toughness in a broad range of temperatures and environments. The materials are preferably solvent resistant. In a preferred embodiment, the attachment members are made from acetals, such as Delrin™ homopolymer from DuPont and Celcon™ copolymer from Heochst-Celanese Corporation. Other suitable materials may include, without limitation, polyesters, polyurethanes, and the like.

Preferably, the positioning lever 38 extends from cam 34 as depicted in FIG. 4. The purpose of the lever 38 is to provide a means for the installer to easily rotate the attachment member 32. Accordingly, the lever 38 may be positioned on the attachment member 32 in any manner consistent with this purpose.

A locking bar 54 may be included with the attachment member 32. Preferably, the locking bar 54 is part of or attached to the positioning lever 38. The locking bar 54 engages a lock 56 protruding from the frame 14 as depicted in FIG. 3. When locked, the cam 34 of the attachment member 32 is in contact with the edge of lens 16 and the flange 36 covers a portion of the lens 16.

Stops 58 may be provided to prevent over-rotation of the attachment members 32. In a preferred embodiment, stops 58 are located on the frame 14. The flange 36 and/or the positioning lever 38, if present, are prevented from rotating past the position of the stop 58.

A seal may be provided along the face shield frame 14 to seal the face shield frame 14 to the helmet 12.

Referring to FIG. 3, the face shield frame 14 has alignment members 24 disposed along its inside surface. The frame alignment members 24 correspond to alignment guides 22 on the lens 16. The frame alignment members 24 may be of a variety of structures. The alignment members 24 align the lens 16 in position within the frame 14 by communicating with the lens alignment members 24. In a preferred embodiment, the frame alignment members 24 are pins and ridges. The pins and ridges interlock with corresponding guides 22 on the lens 16. Preferably, the lens guides 22 are slots that correspond with the ridges and holes that correspond with the pins. The combination of pins, ridges, slots, and holes permits relatively easy alignment of the lens 16 within the frame 14 yet provides sufficient structure to retain the lens 16 on the frame 14 while the attachment members 32 are rotated into place.

Returning to FIG. 1*b*, as mentioned above, the helmet includes support elements 15. Support elements 15 may comprise the leading edge of the helmet viewing area 21. Preferably, support elements 15 extend from the leading edge of the viewing area 21. The support elements 15 cover the lens 16 in a manner similar to the flanges 36. Preferably, the support elements 15 cover the lens 16 within 0 to 4 millimeters of the lens surface. Most preferably, the support elements 15 touch the lens surface. The size of the support elements 15 may vary according to the amount of clearance desired for the face shield frame 14 as it is repositioned with respect to helmet 12.

In a preferred embodiment of the method of the present invention, a respirator 12 having support elements 15 and including a face shield frame 14 with a replaceable lens 16 as described above is provided. The face shield frame 14 has a plurality of attachment members 32 rotatably attached thereto. The attachment members 32 each include a cam 34 and flange 36 and may include a positioning lever 38. The face shield frame 14 preferably includes alignment members 24 and the lens 16 includes alignment guides 22.

With reference to FIG. 3, the flat lens 16 is bowed and inserted in the frame 14. If alignment members 24 and guides 22 are provided, the lens 16 is aligned with the frame 14 by inserting the members 24 into the guides 22. The bowing of the lens results in the lens pushing against the frame. Referring to the attachment members designated as 32*a* for illustration purposes, the attachment members 32*a* are rotated such that cam 34*a* contacts the edge of the lens 16 and urges the lens 16 against the frame 14. The combination of the bowed lens and the force exerted by the cams acts to seal lens 16 against frame 14.

Preferably, the attachment members 32 are provided with a positioning lever 38. The positioning lever 38 may further include a locking bar 54 or a locking bar 54 may be provided as a separate element. The locking bar 54 and/or attachment member 32 may be rotated over a protruding lock 56. With continuing reference to FIG. 3, when in the locked position, cam 34 is in contact with the lens 16 and the flange 36 covers the lens 16. The flanges 36 and support elements 15 of the helmet respirator 12 provide a measure of impact resistance to the lens 16.

To remove the lens 16, the attachment members (designated 32*b* for illustration purposes) are rotated such that they substantially disengage the lens 16 and the flanges 36 no longer effectively cover the lens 16. The lens 16 is then capable of being removed from the frame 14.

The following examples illustrate aspects of the present invention but are not intended to be limiting thereof.

EXAMPLES

Face shields were prepared as described above and attached to helmet respirators in accordance with the detent system disclosed in commonly assigned U.S. patent application Ser. No. 09/037,633, filed Mar. 10, 1998 entitled Protective Helmet System, filed on the same date herewith. The helmet respirators included two support elements made of Xenoy™ resin, a polycarbonate/polyester blend available from the General Electric Company ("GE"). The support elements covered the lenses within 4 millimeters. The face shields included a polycarbonate lens made of Type CTG polycarbonate available from GE that was 0.10 cm. (0.040 inches) in thickness. The lens was secured in the frame in accordance with the description set forth above by four attachment members made from Celcon™ M90, an acetal copolymer available from the Celanese Corporation. The flanges of the attachment members covered the lenses within 4 millimeters. The face shields were tested for physical integrity upon high mass impact and for leakage.

Example I

Impact Resistance

The face shields were tested for high mass impact according to ANSI standard Z87.1-1989. This test is intended to ensure a level of mechanical integrity of a protective device and a level of protection from relatively heavy, pointed objects traveling at low speed. The face shield was rigidly mounted on a headform in the horizontal position, face up. A missile having a 30° conical tip with a 1 mm (0.039 in.) radius made of heat-treated steel weighing 500 grams (17.6 ounces) was dropped through a loose-fitting guide tube onto the lens from a height of 130 cm. (51.2 in.). The alignment was such that when the missile was dropped, its point was in line with one of the eyes of the headform. Four face shield samples were tested. None of the samples showed any fracture or dislodgment of the lens. All samples passed this test.

Example II

Respiratory Protection

The face shields were tested for gas or vapor leakage by assembling them into a respirator system and testing according to the NIOSH standard for respirators 42CFR Part 84, as published in the Federal Register, Vol. 60, No. 110, paragraph 84.162, page 30379, Jun. 8, 1995. The completely assembled respirators were fitted to the wearer with an appropriate face seal and were then worn in a chamber containing 0.10% (1000 ppm) isoamyl acetate vapor. Each subject performed light exercise for 10 minutes in the chamber. Any detection of the odor of isoamyl acetate by the subject is considered failure, while no detection of the odor of isoamyl acetate by the subject is passing. Ten face shields were tested in various respirator combinations by various subjects, and all passed the test.

The complete disclosures of all patent applications and patents referred to in this detailed description of the preferred embodiment of this specification are incorporated herein as if individually incorporated.

Although various embodiments of the invention have been described in detail in the foregoing for purposes of illustration, it is to be understood that such details are solely for that purpose and that variations may be made therein by those skilled in the art without departing from the spirit and scope of the invention as described in the following claims.

What is claimed is:

1. A respiratory lens attachment system, comprising:

a. an arcuate face shield frame having an inside surface and a plurality of rotatable attachment members disposed on said inside surface, an attachment member comprising a cam and a flange; and b. a replaceable bowed lens, wherein said attachment cam urges said lens against the inside surface of said face shield frame and said flange covers a portion of said lens.

2. The attachment system of claim 1 wherein said attachment members include a locking bar that corresponds to a lock on said frame wherein said locking bar engages said lock.

3. The attachment system of claim 1 wherein said lens has alignment guides and said frame has alignment members such that said guides and members interlock to align the lens on the frame.

4. The attachment system of claim 1 wherein the face shield is attached to a helmet respiratory device and includes an up position, such that the shield is substantially out of the plane of sight of a wearer and a down position, such that the shield is in a position in front of a wearer's face, and the helmet includes support elements such that the support elements cover the lens when the face shield assembly is in the down position.

5. The attachment system of claim 1 further comprising stops disposed on said frame to prevent over-rotation of said attachment members.

6. A respiratory lens attachment system, comprising:

a. a helmet respirator with a support element;

b. a face shield frame attached to said helmet respirator, said face shield frame having an inside surface including a plurality of attachment members, an attachment member comprising a cam and a flange, said attachment members disposed on the inside surface of said frame; and c. a replaceable bowed lens, wherein said cam urges said lens against said inside surface of said face shield frame and said flange covers a portion of said lens.

7. The lens attachment system of claim 6 wherein the face shield frame has alignment members and said lens has alignment guides such that the face shield is positioned within the frame by aligning the alignment guides with the alignment members.

8. The lens attachment system of claim 6 wherein said frame has lock protrusions, such that the lock protrusions engage the attachment members.

9. The lens attachment system of claim 6 wherein said frame has stops that prevent over-rotation of said attachment members.

10. The lens attachment system of claim 7 wherein the alignment members comprise pins.

11. The lens attachment system of claim 7 wherein the alignment guides comprise slots.

12. The lens attachment system of claim 6 wherein lens is polycarbonate.

13. The lens attachment system of claim 6 wherein the lens has a scratch resistant coating.

14. The lens attachment system of claim 6 wherein the lens is tinted.

15. A method of inserting a replaceable face shield lens in a respiratory device, comprising:

a. providing a helmet respirator having a support member and a face shield frame attached thereto, said face shield frame having an inside surface with rotatable attachment members disposed on said inside surface, said attachment members having a cam and a flange;

b. bowing a flat lens and inserting said lens into said frame; and c. rotating said attachment members such that the cam urges said lens against said inside surface of said face shield frame and said flange covers a portion of the lens, said support members and said flanges providing impact resistance to the lens.

16. The method of claim 15 wherein the face shield frame has alignment members and said lens has alignment guides and the bowed lens is positioned on said frame by aligning the alignment members with the alignment guides.

17. The method of claim 15 wherein said frame has a plurality of lock protrusions and said attachment members are rotated over said lock protrusions.

18. The method of claim 16 wherein the alignment members comprise pins.

19. The method of claim 16 wherein the alignment guides comprise slots.

20. The method of claim 15 wherein the lens is polycarbonate.

21. The method of claim 15 wherein the lens has a scratch resistant coating.

22. The method of claim 15 wherein the lens is tinted.

23. The method of claim 15 wherein the helmet has a viewing area with a leading edge and said support members comprise two protrusions extending from said leading edge.

* * * * *